US008104195B2

(12) United States Patent
Cavasin

(10) Patent No.: US 8,104,195 B2
(45) Date of Patent: Jan. 31, 2012

(54) SPORTS SHOE

(75) Inventor: Massimo Cavasin, Montebelluna (IT)

(73) Assignee: Roces—S.R.L., Montebelluna (IT)

( * ) Notice: Subject to any disclaimer, the term of this patent is extended or adjusted under 35 U.S.C. 154(b) by 981 days.

(21) Appl. No.: 12/010,450

(22) Filed: Jan. 25, 2008

(65) Prior Publication Data

US 2009/0000151 A1 Jan. 1, 2009

(30) Foreign Application Priority Data

Jun. 27, 2007 (IT) ..... VE20070020 U

(51) Int. Cl.
*A43B 3/26* (2006.01)
*A43B 5/04* (2006.01)

(52) U.S. Cl. ..... 36/97; 36/117.3

(58) Field of Classification Search ..... 36/97, 117.3, 36/117.1, 115; 280/11.19, 11.26
See application file for complete search history.

(56) References Cited

U.S. PATENT DOCUMENTS

| | | | | |
|---|---|---|---|---|
| 1,633,413 | A | 6/1927 | La Marca Stefano | |
| 5,779,246 | A | 7/1998 | Bengtsson | |
| 6,827,355 | B2 * | 12/2004 | Soo | 280/11.19 |
| 7,278,641 | B1 * | 10/2007 | Soo | 280/11.26 |
| 2001/0028152 | A1 | 10/2001 | Ricci | |
| 2004/0108665 | A1 | 6/2004 | Soo | |

FOREIGN PATENT DOCUMENTS

| | | |
|---|---|---|
| EP | 1 428 443 A | 6/2004 |
| EP | 1 714 570 A | 10/2006 |
| FR | 2 870 684 | 12/2005 |

* cited by examiner

*Primary Examiner* — Ted Kavanaugh
(74) *Attorney, Agent, or Firm* — Modiano & Associati; Albert Josif; Daniel J. O'Byrne

(57) ABSTRACT

A sports shoe which comprises a rigid sole from which a shell protrudes, starting from a forefoot region and up to a heel region, a quarter being rotatably associated with the shell. An insole is slidingly associated within the shell, at a bottom thereof, is provided with a tip and interacts with elements for adjusting and guiding its axial position with respect to the shell.

15 Claims, 10 Drawing Sheets

SPORTS SHOE

The present invention relates to a sports shoe, particularly a ski boot or an inline skate or ice skate.

BACKGROUND OF THE INVENTION

Ski boots, ice skates and in-line skates are currently used which have a shell constituted by a front portion and a separate rear portion, which are mutually slidingly associated in order to allow the user to change the length of the shell. This solution allows to adapt the shoe to the particular morphological characteristics of the user and/or to achieve a change of size which allows said known types of shoe to be worn even by users who have feet of different sizes or by children who over time will change foot size rapidly.

For example, EP-A-1714570 and US-2006-0230638-A1 disclose a ski boot which comprises a standardized rigid sole from which a shell protrudes in the region of the forefoot and approximately up to the arch region, the shell being open toward the heel region, a counter being slidingly associable with said shell in a rear region and interacting with means for adjusting and guiding the axial position with respect to the sole, a quarter whose height can be adjusted being rotatably associated therewith.

However, this known type of ski boot, while allowing to vary the length of the shell and the height of the quarter, so as to be able to adapt to the specific size of the foot and of the leg of the user, has a drawback: between the shell and the counter there can in fact be plays which may allow the penetration of snow or water into the boot, with the consequent user discomfort that this entails.

Further, since the shell is provided in two components, the strength and stability of this known type of ski boot are limited.

Italian utility model patent No. 00251472 discloses a sports shoe, particularly a skate with inline wheels or an ice skate whose size is adjustable, which is constituted by a tip and a separate heel unit, with which a first support and a second support for one or more wheels or an ice-skating blade are associable or rigidly coupled respectively in a lower region, said supports being provided with means for mutual longitudinal sliding.

Means for connecting and adjusting the mutual axial position which can be activated by means of a retractable lever are provided between the tip and the heel unit.

This known type of skate also has the same drawbacks observed in the previous background art.

SUMMARY OF THE INVENTION

The aim of the present invention is to solve the above mentioned problems, eliminating the drawbacks of the cited background art, by providing a sports shoe, particularly a ski boot or an ice skate or in-line skate, which adapts to the specific size of the user and at the same time prevents the penetration of snow or water inside it.

Within this aim, an object of the invention is to provide a sports shoe which is tough and stable, thus ensuring adequate protection and correct support to the foot of the user.

Another object is to provide a sports shoe which is structurally simple and has low manufacturing costs.

This aim and these and other objects, which will become better apparent hereinafter, are achieved by a sports shoe which comprises a rigid sole from which a shell protrudes, starting from the forefoot region and up to the heel region, a quarter being rotatably associated with said shell, characterized in that an insole is slidingly associated within said shell, at the bottom thereof, is provided with a tip and interacts with means for adjusting and guiding its axial position with respect to said shell.

BRIEF DESCRIPTION OF THE DRAWINGS

Further characteristics and advantages of the invention will become better apparent from the following detailed description of a preferred but not exclusive embodiment thereof, illustrated by way of non-limiting example in the accompanying drawings, wherein.

DESCRIPTION OF THE PREFERRED EMBODIMENTS

Figure 1:
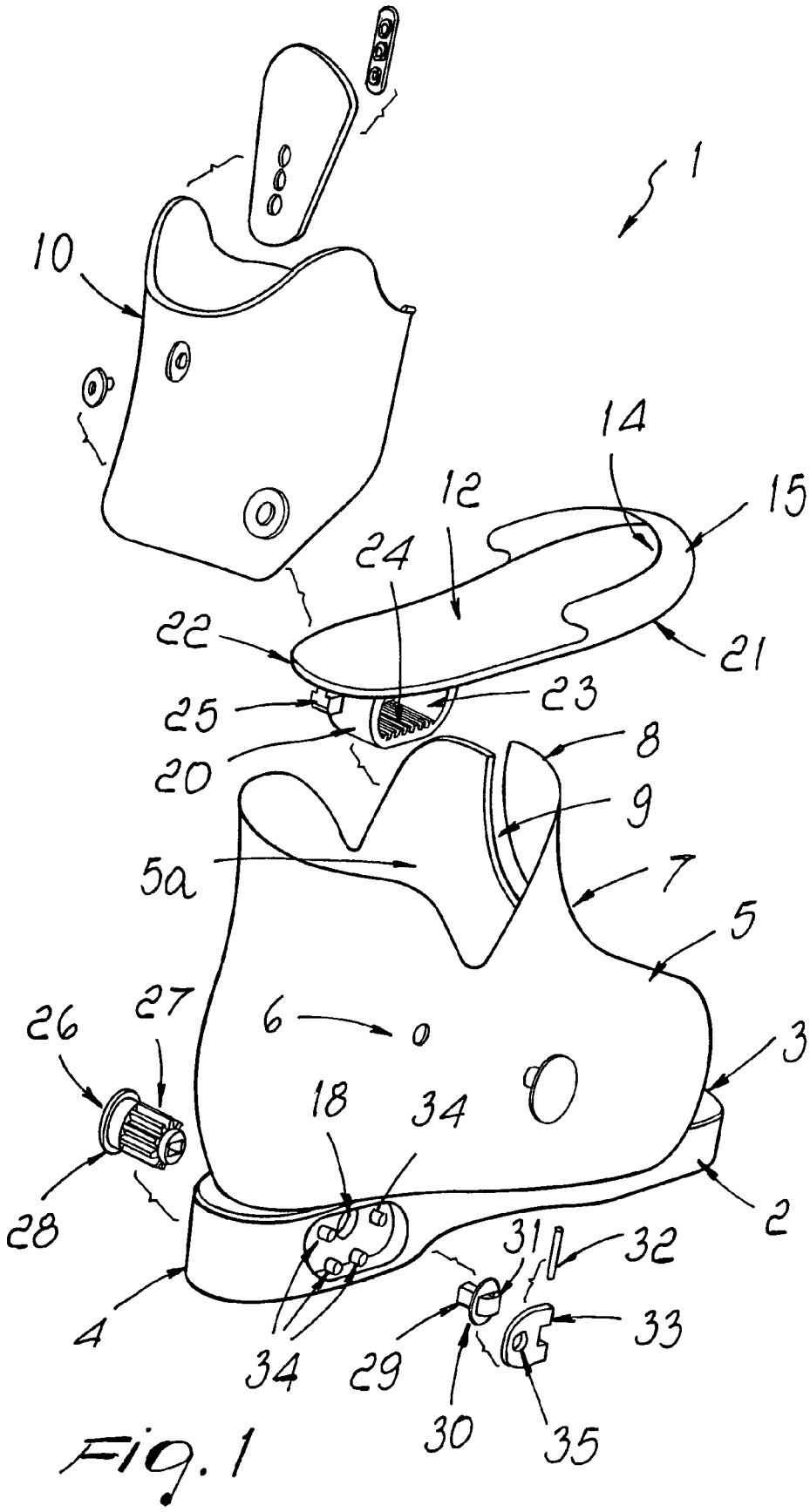
FIG. 1 is an exploded perspective view of a sports shoe according to a first embodiment of the invention.
Figure 2:
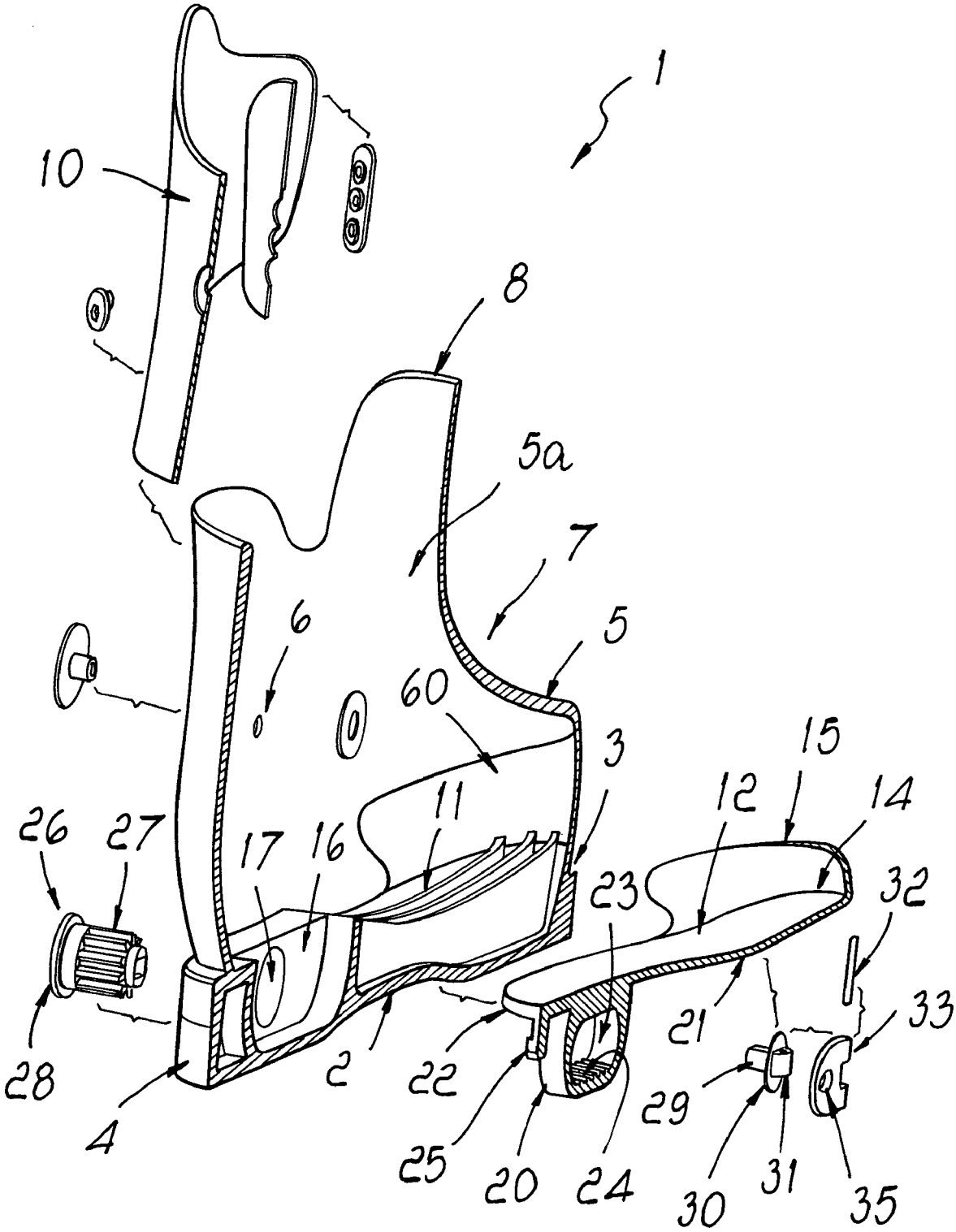
FIG. 2 is an exploded sectional perspective view, taken along a longitudinal central plane, of the sports shoe of FIG. 1.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

With reference to FIGS. 1 to 6, the reference numeral 1 designates a sports shoe, such as a ski boot, which comprises a rigid sole 2; in the example shown in the accompanying FIGS. 1 to 6, the shoe 1 is constituted by a ski boot and the sole 2 is therefore of the standardized type.

As an alternative to the illustrated embodiment, it is possible to associate below the sole 2 for example an ice-skating blade or a support for one or more wheels.

A shell 5 protrudes from the sole 2, starting from a forefoot region 3 and up to a heel region 4, is provided monolithically and during use surrounds completely the foot of the user, extending so as to cover a malleolar region 6 and the foot instep. Advantageously, the shell 5 is made of rigid plastic material.

The shell 5 is open in an upper region and advantageously has, approximately in the region of the foot instep 7 and starting from its upper perimetric edge 8, a slit 9 which is suitable to facilitate the insertion of the foot of the user.

Advantageously, a slot 60 having an approximately U-shaped plan is formed in an inner lateral surface 5*a* of the shell 5, starting from the forefoot region 3, so as to partially follow the profile of the shell 5; the slot 60 therefore affects partially a front end 61 and side walls 62*a*, 62*b* of the shell 5, starting from a bottom 11 of the latter.

Figure 5:
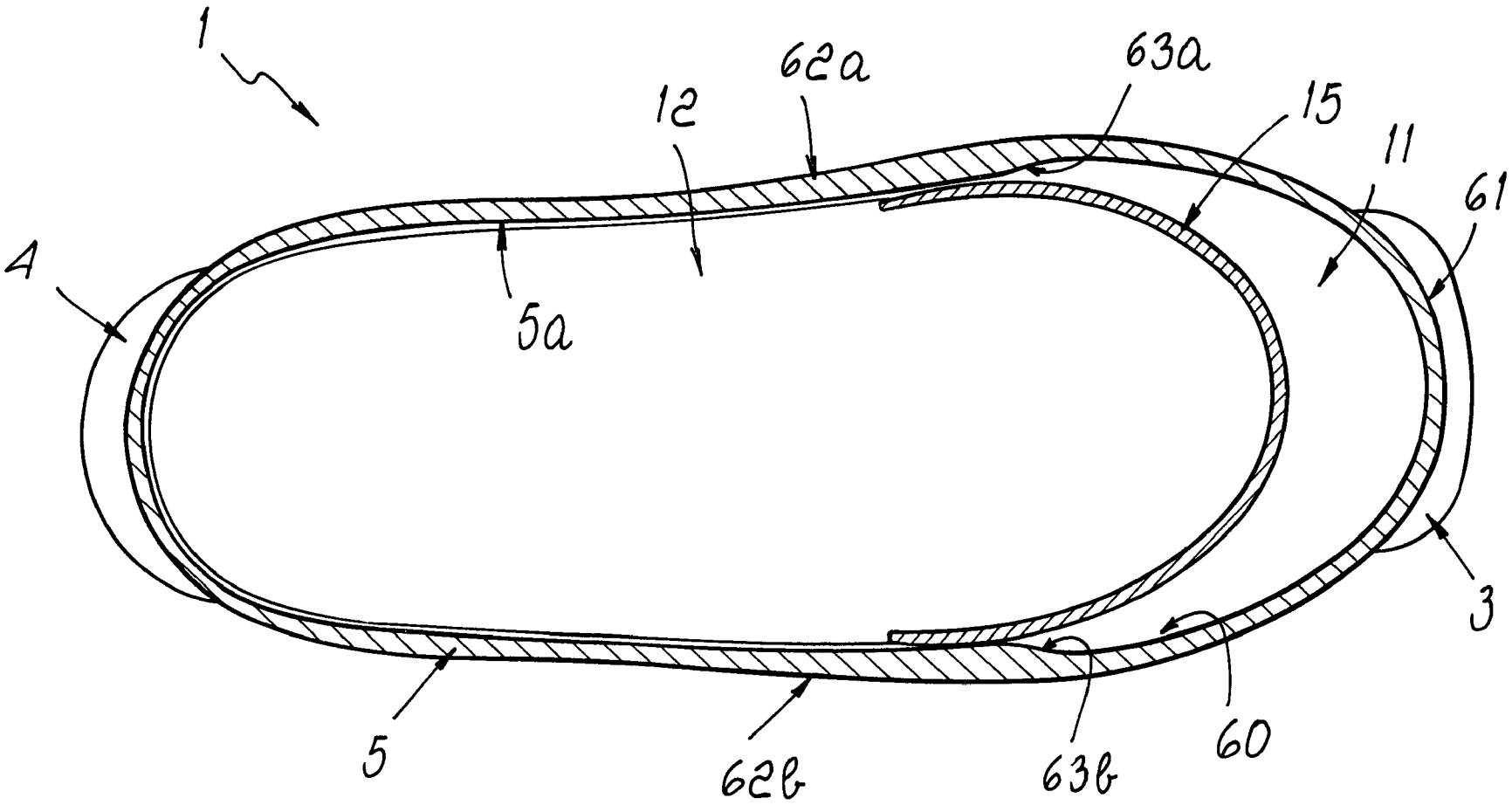
FIG. 5 is a sectional view, taken along the line V-V of FIG. 3.

Advantageously, the ends of the slot 60 that are directed toward the heel region 4 are connected to the inner lateral surface 5*a* of the shell 5 through two inclined surfaces, designated by the reference numerals 63*a* and 63*b* in FIG. 5.

A quarter 10, preferably of the height-adjustable type, is rotatably associated with the shell 5 approximately at the malleolar region 6.

An insole 12 is slidingly associated within the shell 5, at its bottom 11, and is made for example of rigid or semirigid plastic material; a tip 15 protrudes from said insole approximately at the region 14 of the toes and is suitable to wrap around the toes of the user during use, optionally with the interposition of an appropriately provided innerboot, not shown in the accompanying figures, which is made for example of soft material in order to increase wearing comfort.

Figure 6:
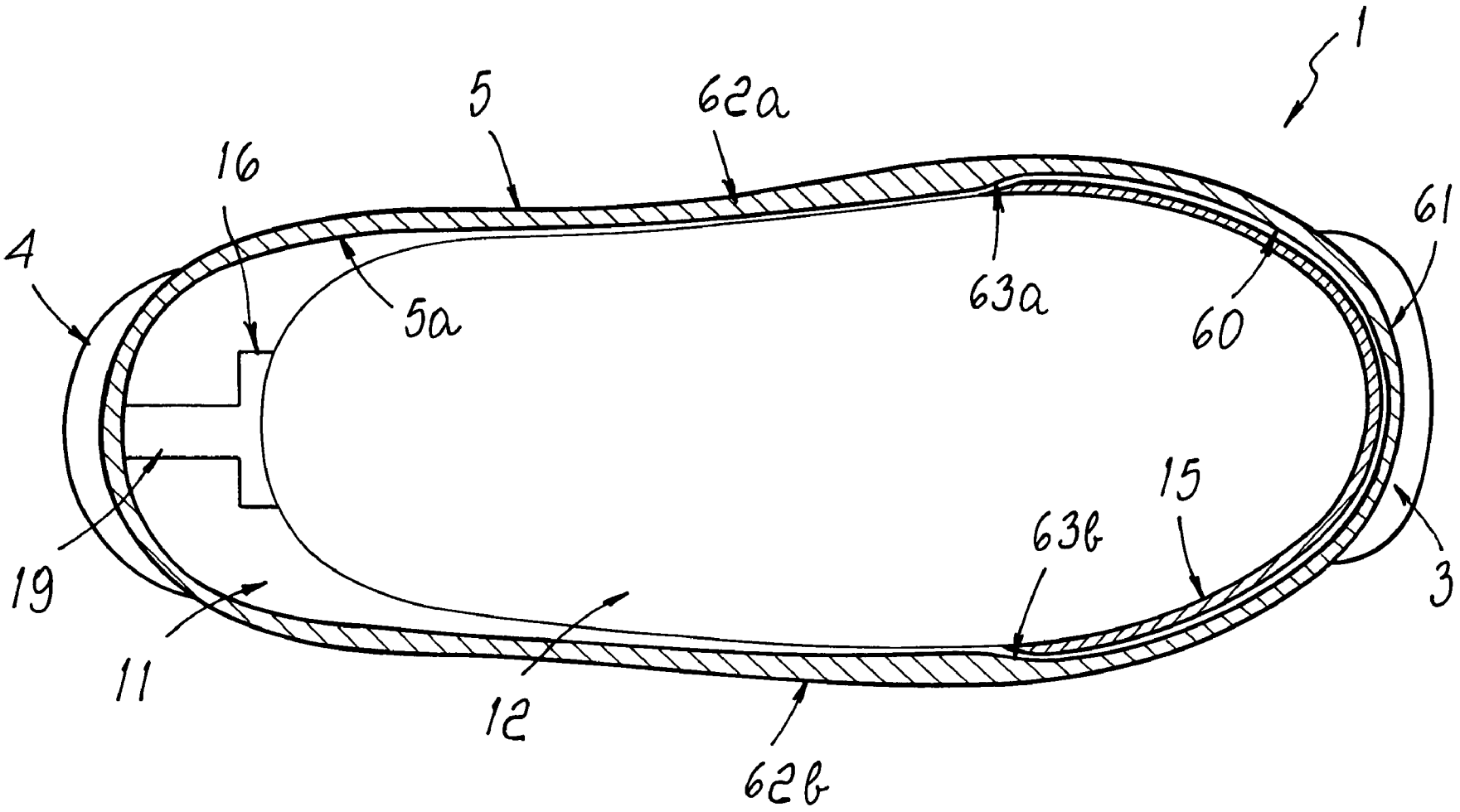
FIG. 6 is a sectional view, taken along the line VI-VI of FIG. 4.
Figure 7:
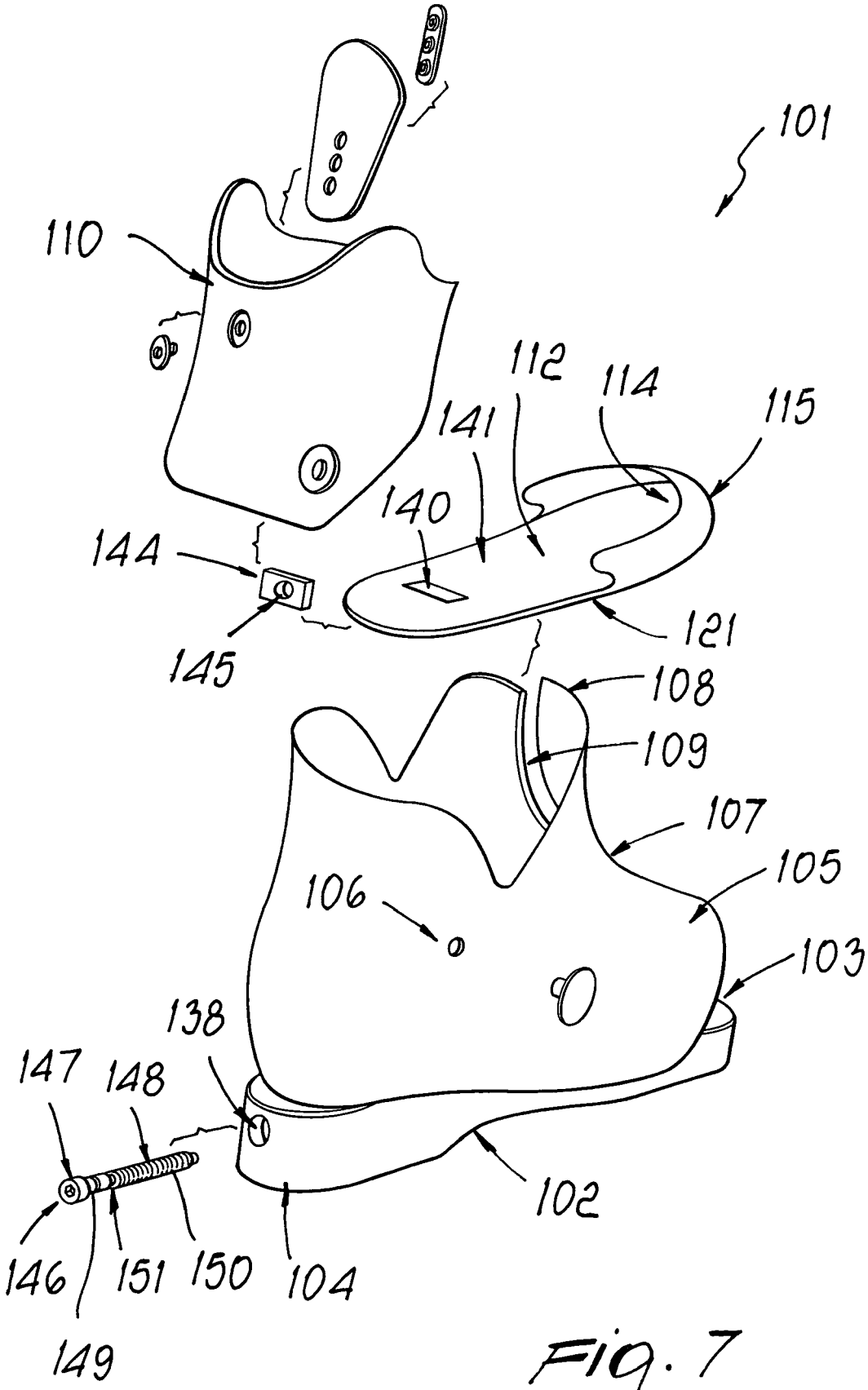
FIG. 7 is an exploded perspective view of a second embodiment of a sports shoe according to the invention.
Figure 8:
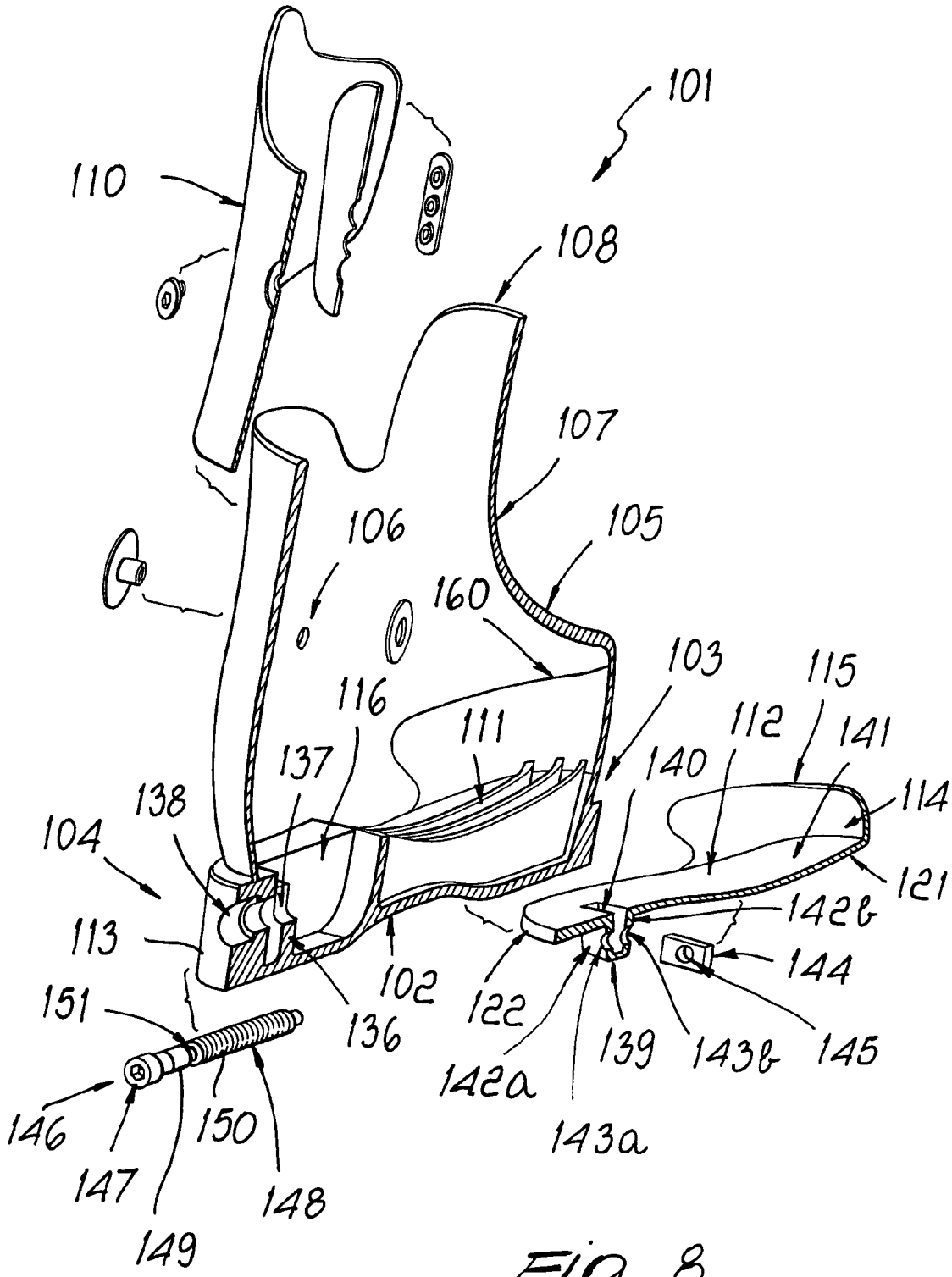
FIG. 8 is an exploded perspective view, taken along a longitudinal central sectional plane, of the sports shoe of FIG. 7.
Figure 9:
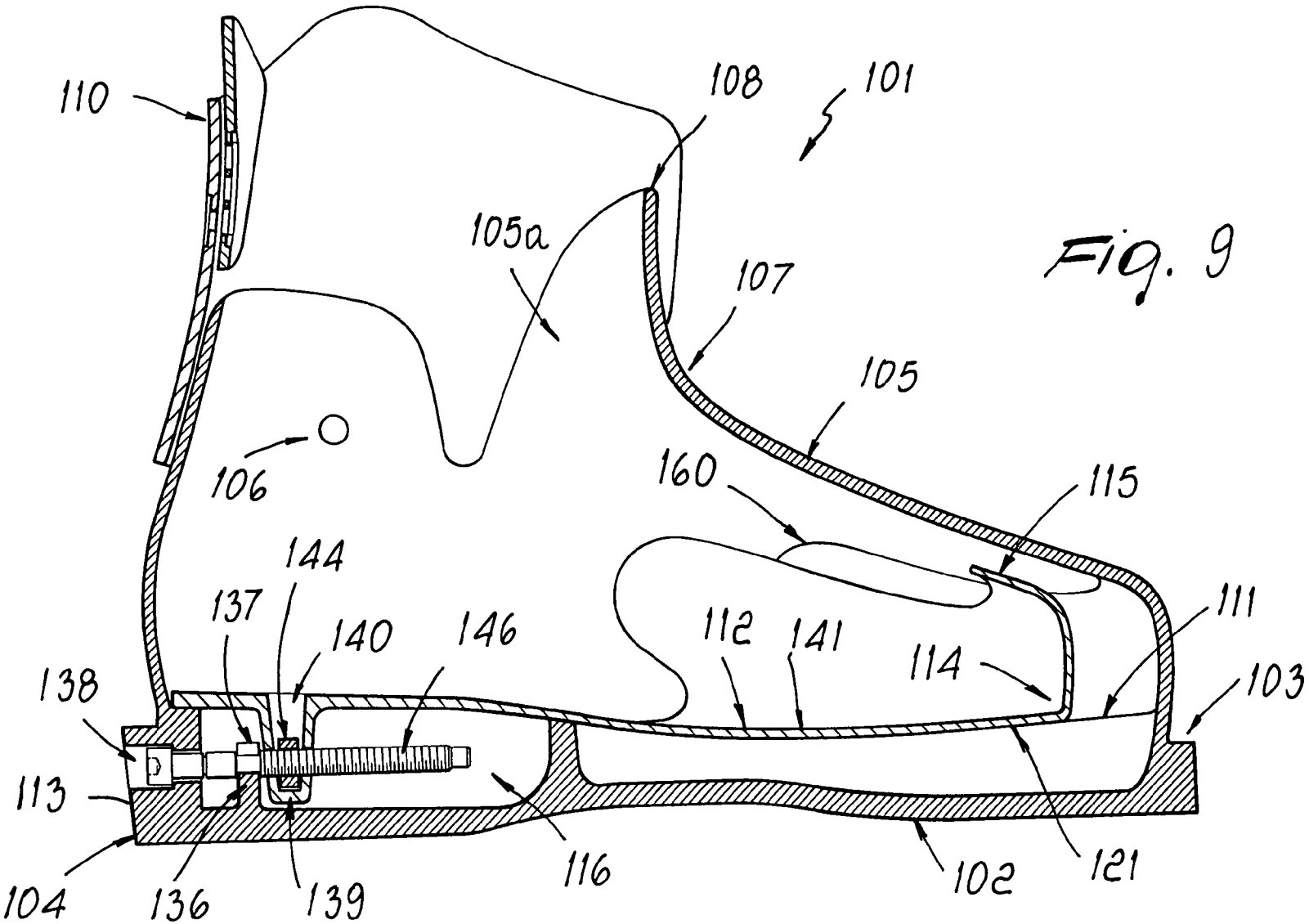
FIG. 9 is a sectional view, taken along a longitudinal central plane, of the sports shoe according to FIGS. 7 and 8 in the condition of maximum retraction of the insole.
Figure 10:
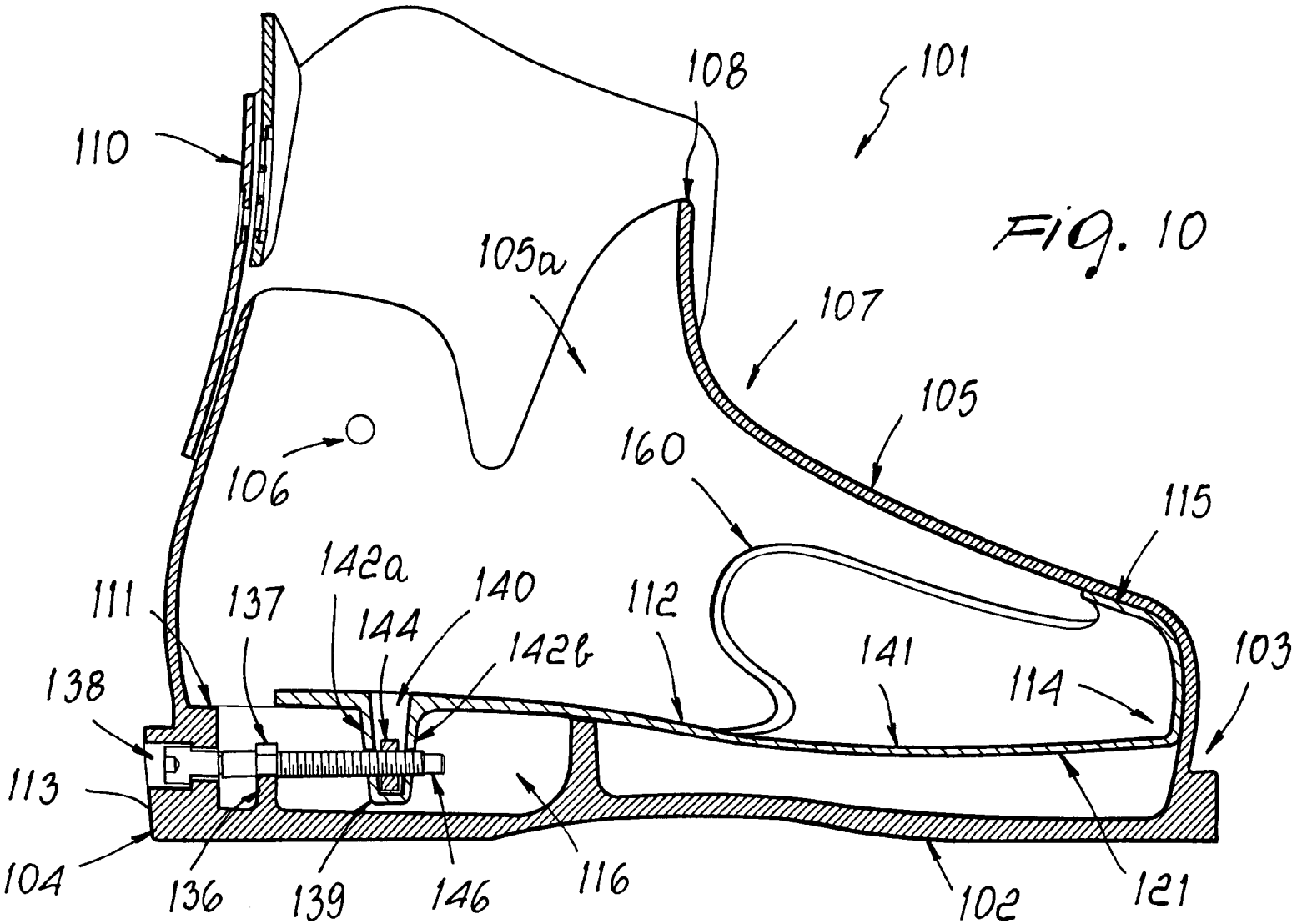
FIG. 10 is a view, similar to the preceding one, of the sports shoe in the condition of minimum retraction of the insole.

Advantageously, as shown in FIGS. 5 and 6, the dimensions of the tip 15 are such that in the condition of the maximum retraction of the insole 12 with respect to the shell 5, and therefore at the minimum size, shown in FIG. 5, in which the tip 15 is arranged outside the slot 60, such tip is compressed radially by the inner lateral surface 5*a* of the shell 5, thus reducing the space inside the sports shoe 1 that is available to accommodate the foot of the user and the optional soft innerboot which can be arranged thereat.

In this condition, the tip 15 is not deformed at right angles to the bottom 11 of the shell 5, since the expansion of the latter in the region of the foot instep 7, as one approaches the heel region 4, allows the expansion of the tip 15.

In the condition of minimum retraction of the insole 12 with respect to the shell 5, and therefore of maximum size, shown in FIG. 6, in which the tip 15 is arranged at the slot 60, the tip 15 is instead in its non-deformed condition, providing more space for the foot of the user or for the optional innerboot.

The insole 12 interacts with an adjustment and guiding mechanism for adjusting and guiding its axial position with respect to the shell 5.

Advantageously, such adjustment and guiding mechanism comprises a first seat 16, which is formed in the sole 2 at the heel region 4 starting from the bottom 11 of the shell 5.

The first seat 16 has an approximately rectangular plan shape which extends lengthwise in the direction of the longitudinal axis of the sole 2.

At the mutually facing longitudinal lateral surfaces of the first seat 16 there are respectively, along the same axis, a first hole 17 and a second hole 18; advantageously, the first hole 17 has a larger diameter than the second hole 18.

The first seat 16 is connected to a rear cavity 19 which cooperates to constitute such mechanism for guiding the axial position with respect to the shell 5 and is formed starting from the bottom 11 of the shell, in the portion that runs from the first seat 16 to the rear wall of the shell 5; the cavity 19 is formed, in a transverse cross-section, approximately like an inverted T and has, in plan view, an approximately rectangular shape, whose width and length are advantageously shorter than those of the first seat 16.

The adjustment and guiding mechanism further comprises a first tab 20, which protrudes approximately at right angles from the lower surface 21 of the insole 12 which, during use, is directed toward the bottom 11 of the shell 5, and proximate to the rear end 22 of the insole 12 which lies opposite the region 14 of the fingers.

The first tab 20 can be arranged slidingly at the first seat 16 formed in the sole 2 and is approximately as wide as the first seat 16 and shorter than the first seat, in order to be able to perform a longitudinal translational motion inside it; advantageously, the first tab 20 has, in a longitudinal cross-section, an approximately oval shape and is transversely hollow so as to form a second seat 23 which preferably has the same shape.

A set of teeth 24 is formed transversely at the upper surface or preferably at the lower surface of the second seat 23.

A second tab 25 protrudes from the lower surface 21 of the insole 12, to the rear of the first tab 20, is shaped approximately complementarily with respect to the cavity 19, is shorter than said cavity and can engage slidingly the cavity 19 in order to guide and limit the sliding of the insole 12 longitudinally with respect to the shell 5; the second tab 25 thus cooperates to constitute such mechanism for guiding the axial position with respect to the shell 5.

An additional component for the mechanism for adjusting the axial position with respect to the shell 5 can be positioned within the second seat 23 and is constituted by a first screw 26, which has a first stem 27 which is axially toothed complementarily with respect to the set of teeth 24 and can engage it; the first screw 26 can be positioned rotatably at the first hole 17 and at the second hole 18.

The first screw 26 has, at one of its ends which is adjacent to the first hole 17, an annular ridge 28 whose diameter is larger than the diameter of the first hole 17, so as to abut against the perimetric edge of the latter with the possibility to rotate freely.

The free end of the first screw 26 protrudes from the second hole 18 and is rotatably coupled thereto by means of the axial keying of a pin 29 which supports a disk 30 which has a larger diameter than the second hole 18, so as to abut against the perimetric edge of the latter.

A support 31 protrudes from the disk 30 on the opposite side with respect to the pin 29, and a lever 33 is pivoted thereto by means of a first pivot 32 and is suitable to allow the user to impart the chosen rotation to the first screw 26.

In turn, the lever 33 can rotate against the lateral surface of the sole 2 and can be rigidly coupled to the latter in a chosen position by inserting appropriately provided second pivots 34, which protrude approximately at right angles from the lateral surface of the sole 2, in a third through hole 35 formed in the lever 33.

Use of the invention is therefore as follows: with reference to FIGS. 1 to 6, by acting on the lever 33 the user can turn the first screw 26 through a chosen angle, thus producing the advancement or retraction of the insole 12 with respect to the shell 5 and increasing or reducing accordingly the space inside the sports shoe 1 available to accommodate the foot of the user and the optional soft inner boot which can be positioned thereat.

Once the chosen length has been reached, it is possible to lock the mutual sliding of the insole 12 with respect to the shell 5 by turning the lever 33 so as to achieve the insertion of one of the second pivots 34 in the third hole 35 of the lever 33.

In this manner it is thus possible to achieve a very fine adjustment of the space inside the sports shoe 1 which is available to the foot of the user.

Figure 3:
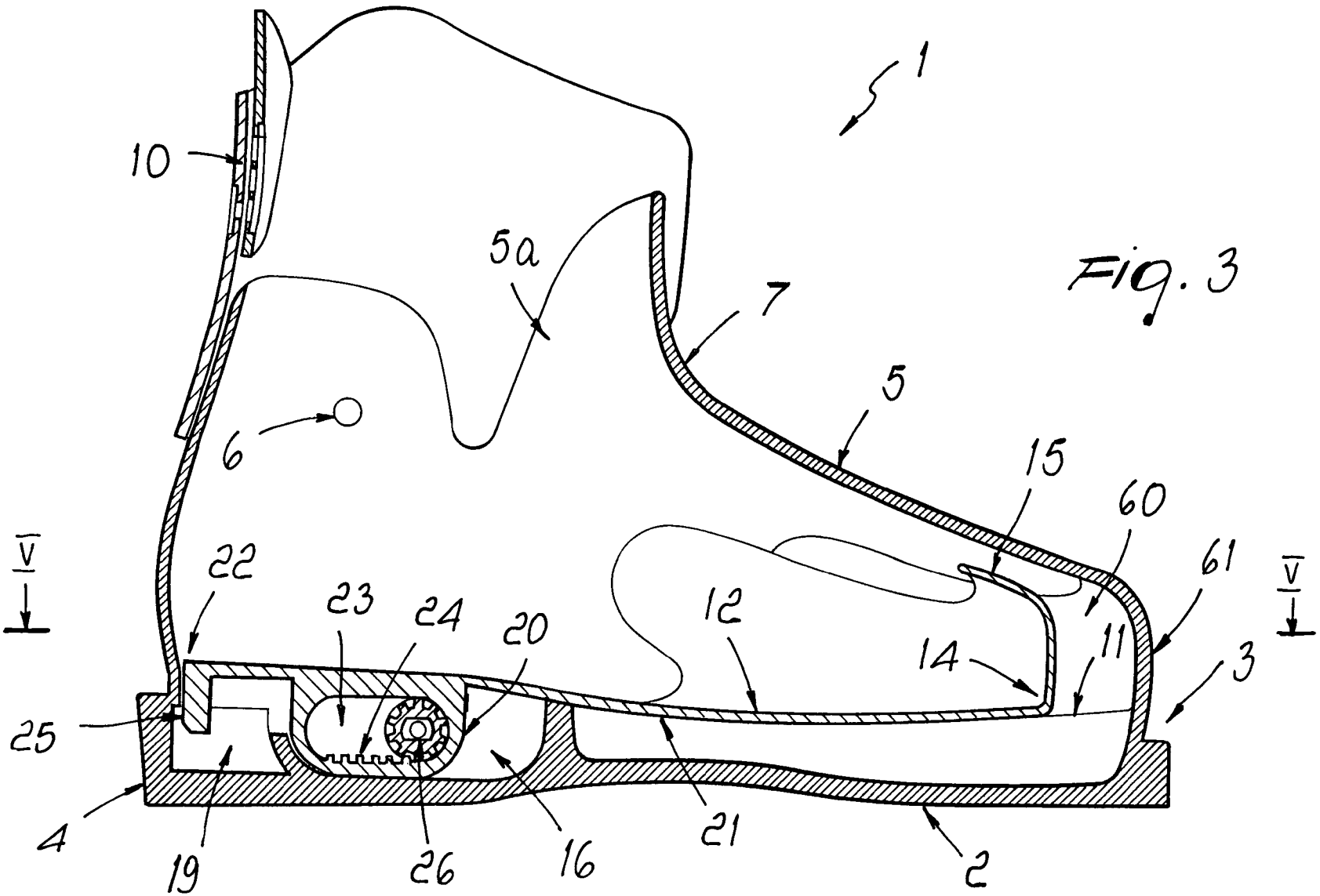
FIG. 3 is a sectional view, taken along a longitudinal central plane, of the sports shoe according to the preceding figures, in the condition of full retraction of the insole.

For example, with reference to the accompanying FIGS. 3 and 5, it is possible to arrange the insole 12 in the condition of maximum retraction with respect to the shell 5; in this condition, the tip 15 is at its minimum distance from the heel region 4 and is further compressed radially by the inner lateral surface 5*a* of the shell 5, thus minimizing the internal space available for the foot of the user or for the optional innerboot that can be positioned thereat.

Figure 4:
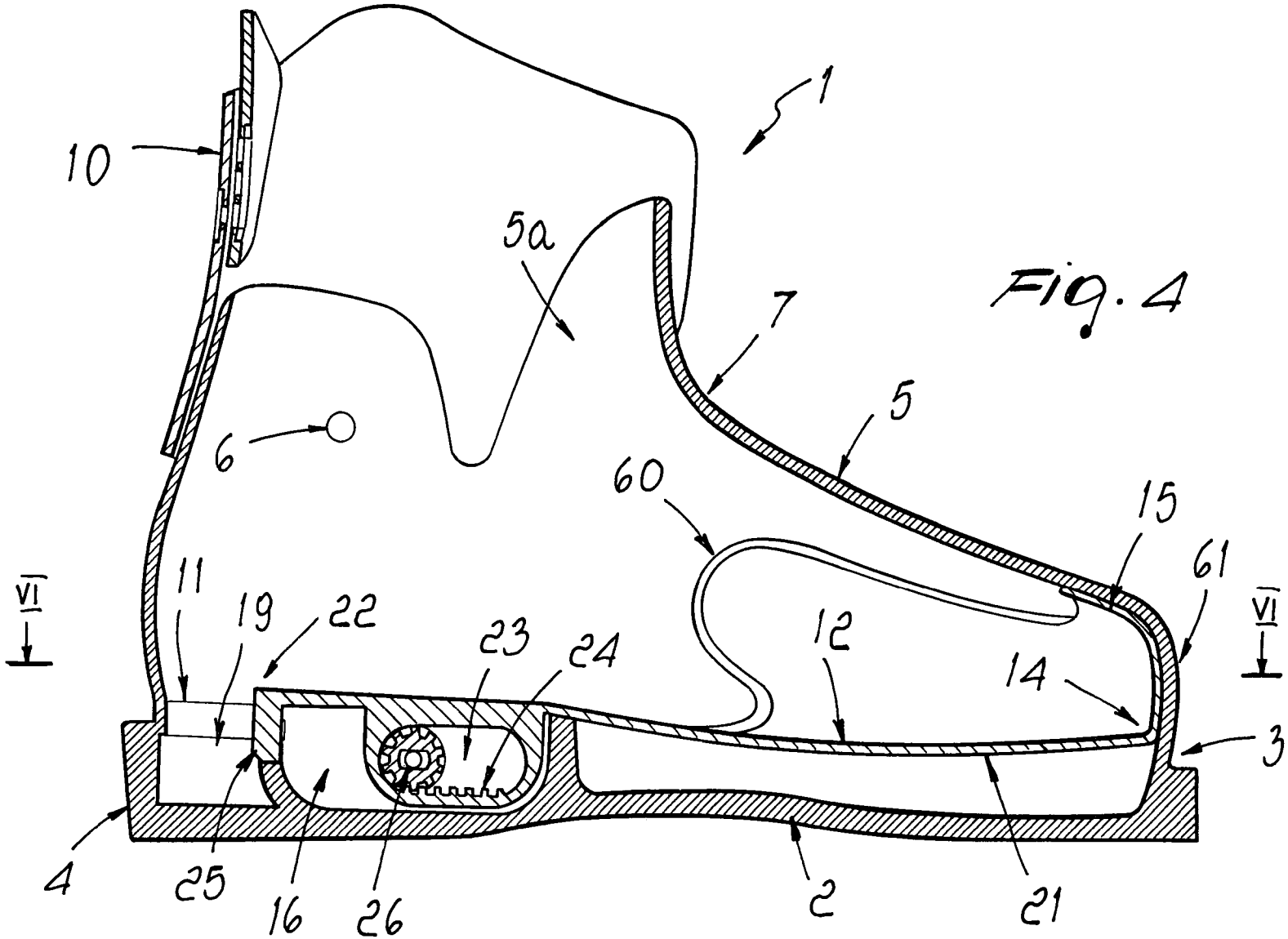
FIG. 4 is a view, similar to the preceding one, of the sports shoe according to the preceding figures in the condition of minimum retraction of the insole.

With reference to FIGS. 4 and 6, the insole 12 is instead positioned in the condition of minimum retraction with respect to the shell 5, so that the tip 15 is at its maximum distance from the heel region 4 and is further not deformed, since it is positioned at the slot 60; in this condition, therefore, the space available for the foot of the user or for the optional innerboot which can be positioned thereat is maximized.

It has thus been found that the invention has achieved the intended aim and objects, a sports shoe, particularly a ski boot or an ice skate or in-line skate, having been devised which allows to vary very easily and quickly the internal space available to the foot of the user, so as to be able to obtain different sizes; further, since the foot, during use, is enclosed within the first shell, which is provided monolithically, the risk of snow or water making contact with the foot is substantially nil.

Further, since the first shell is provided monolithically, the shoe according to the invention is very tough and stable and therefore ensures effective protection and support to the foot of the user.

Moreover, the production costs of the sports shoe according to the invention remain low, since the shoe is obtained only by means of components which are easy to manufacture and/or assemble.

The invention is of course susceptible of numerous modifications and variations, all of which are within the scope of the appended claims.

Thus, for example, a second embodiment of a sports shoe 101, particularly a ski boot or an in-line skate, comprising a rigid sole 102, is described with reference to FIGS. 7 to 10. In the example shown in the accompanying FIGS. 7 to 10, the shoe 101 is constituted by a ski boot and the sole 102 is therefore of the standardized type.

In the case of a skate, not shown in the accompanying figures, it is possible to associate for example an ice-skating blade or a support for one or more wheels below the sole 102.

A monolithically provided shell 105 protrudes from the sole 102, starting from the forefoot region 103 up to the heel region 104 and surrounds the foot of the user completely during use by being extended until it covers the malleolar region 106 and the foot instep region 107.

The shell 105 is open in an upper region and has, approximately in the foot instep region 107 and starting from its upper perimetric edge 108, a slit 109 which is suitable to facilitate the insertion of the foot of the user.

In this second embodiment also, a slot 160 is formed in the inner lateral surface 105*a* of the shell 105, starting from the forefoot region 103, has an approximately U-shaped plan configuration, so as to partially follow the profile of the shell 105, and is similar to the slot 60 described with reference to FIGS. 1 to 6.

A quarter 110, preferably of the vertically adjustable type, is rotatably associated with the shell 105 approximately at the malleolar region 106.

An insole 112 is slidingly associated within the shell 105, at the bottom 111 thereof, and is made for example of rigid plastic material; a tip 115 protrudes from said insole, approximately at the toe region 114, and is suitable to surround the toes of the user during use, optionally with the interposition of an appropriately provided innerboot, not shown in the accompanying figures, which is made for example of spongy material and is suitable to increase wearing comfort for the user.

In this second embodiment also, the dimensions of the tip 115 are such that in the condition of maximum retraction of the insole 112 with respect to the shell 105, and therefore at the minimum size, the tip 115 is compressed radially by the inner lateral surface 105*a* of the shell 105, thus reducing the space inside the sports shoe 101 that is available to accommodate the foot of the user and the optional soft innerboot which can be positioned thereat.

In the condition of minimum retraction of the sole 112 with respect to the shell 105, and therefore at the maximum size, the tip 115 is instead in its non-deformed condition, providing more space to the foot of the user or to the optional innerboot.

The insole 112 interacts with an adjustment and guiding mechanism for adjusting and guiding its axial position with respect to the shell 105.

Advantageously, the guiding mechanism comprises a first seat 116, which is formed in the sole 102 at the heel region 104 starting from the bottom 111 of the shell 105.

The first seat 116 has an approximately rectangular plan shape which is extended lengthwise in the direction of the longitudinal axis of the sole 102.

A third tab 136 which is shaped substantially like a parallelepiped protrudes approximately at right angles, and adjacent to the heel region 104, from the bottom of the first seat 116, and a third seat 137 is formed at its upper end and has a preferably approximately U-shaped profile.

A fourth hole 138 is formed at the rear surface 113 of the heel, approximately along the longitudinal central axis of the sole 102 and along the same axis as the third seat 137.

Conveniently, the fourth hole 138 has an approximately T-shaped diametrical cross-section.

In this second embodiment, the adjustment and guiding mechanism further comprises a fourth tab 139, which protrudes approximately at right angles from the lower surface 121 of the insole 113 proximate to the rear end 122 of the latter which lies opposite the toe region 114.

The fourth tab 139 can be arranged slidingly at the first seat 116 formed in the sole 112, is approximately as wide as the first seat 116 and is shorter than said seat, in order to be able to perform a longitudinal translational motion inside it.

Advantageously, the fourth tab 139 is approximately parallelepipedal and hollow and can be accessed through an opening 140, which has a preferably rectangular plan shape and is formed in the upper surface 141 of the insole 112.

Two fifth holes 143*a*, 143*b* are formed respectively, along the same axis as the fourth hole 138, in the transverse walls 142*a*, 142*b* of the fourth tab 139 which during use are arranged approximately at right angles to the longitudinal central axis of the sole 102.

A complementarily shaped nut 144 can be accommodated within the fourth tab 139 and a sixth threaded hole 145 is formed therein and arranged during use along the same axis as the fifth holes 143*a* and 143*b*.

Advantageously, the mechanism for adjusting and guiding the axial position with respect to the first shell 105 comprises an appropriately provided second screw 146, which has a head 147 which during use is positioned within the fourth hole 138 and from which a second stem 148 protrudes which is constituted by a first smooth portion 149, which is adjacent to the head 147 and is followed by a second portion 150 which is threaded complementarily with respect to the thread of the sixth hole 145 of the nut 144, so that it can be engaged by screwing therein; between the first and second portions there is advantageously a recess 151, which is positioned so that it can rotate, during use, within the third seat 137 of the third tab 136, so as to rigidly couple the longitudinal position of the second screw 146 with respect to the sole 102.

By applying a suitable axial rotation to the second screw 146, one achieves the advancement or retraction, longitudinally thereto, of the nut 144 and the consequent advancement or retraction of the insole 112, which is rigidly coupled to the nut 144, with respect to the shell 105, thus achieving the chosen variation of the space inside the sports shoe 101 that is available to the user's foot.

The materials used, as well as the dimensions that constitute the individual components of the invention, may of course be more pertinent according to specific requirements. The various means for performing certain different functions need not certainly coexist only in the illustrated embodiment but can be present per se in many embodiments, including ones that are not illustrated. The characteristics indicated as advantageous, convenient or the like may also be omitted or be replaced with equivalents.

The disclosures in Italian Utility Model Application No. VE2007U000020 from which this application claims priority are incorporated herein by reference.

What is claimed is:

1. A sports shoe comprising a rigid sole from which a shell protrudes, starting from a forefoot region and up to a heel region, a quarter being rotatably associated with said shell, an insole being slidingly associated within said shell, at a bottom thereof, said insole being provided with a tip and interacting with an adjustment and guiding mechanism for adjusting and guiding an axial position of said insole with respect to said shell, a slot being formed in an inner lateral surface of said shell, starting from said forefoot region, and having an approximately U-shaped plan configuration, so as to follow partially a profile of said shell, partly affecting front end and side walls of said shell, starting from the bottom of the shell, ends of said slot that are directed toward said heel region being blended with said inner lateral surface of said shell through two inclined surfaces.

2. The shoe of claim 1, wherein an insole made of rigid or semirigid plastic material is slidingly associated within said shell at a bottom thereof.

3. The shoe of claim 1, wherein said tip protrudes from said insole, approximately at a toe region, and is adapted to wrap around the user's toes, the shoe further comprising a soft innerboot arranged for being interposed between the user's toes and said tip.

4. The shoe of claim 1, wherein said adjustment and guiding mechanism comprises a first seat which is formed in said sole at the heel region, starting from the bottom of said shell, said first seat having, in plan view, an approximately rectangular shape which is extended lengthwise in a direction of a longitudinal axis of said sole, a first hole and a second hole being provided along a same axis at mutually facing longitudinal lateral surfaces of said first seat, said first hole having a larger diameter than said second hole, said first seat being connected to a rear cavity which is formed starting from said bottom and having an approximately inverted T-shaped transverse cross-section and an approximately rectangular plan shape.

5. The shoe of claim 4, wherein said adjustment and guiding mechanism comprises a first tab, which protrudes approximately at right angles from the lower surface of said insole which is adjacent to said heel region and is directed, during use, toward said bottom, said first tab being slidingly arrangeable at said first seat and being transversely hollow so as to form a second oval seat at the upper or lower surface of which a set of teeth is provided transversely, a second tab protruding from said lower surface, to the rear of said first tab, and being shaped approximately complementarily with respect to said cavity and slidingly engageable therewith in order to guide and limit the sliding of said insole axially with respect to said shell, a first screw being arrangeable within said second seat and having a first stem which is provided axially with complementary teeth with respect to said set of teeth and can engage it, said first screw being rotatably arrangeable at said first and second holes.

6. The shoe of claim 5, wherein said first screw has, at one end thereof which is adjacent to said first hole, an annular ridge which has a larger diameter than said first hole, a free end of said first screw protruding from said second hole and being rotatably coupled to said second hole by way of an axial keying of a pin which supports a disk which has a larger diameter than said second hole, a support protruding from said disk, on an opposite side with respect to said pin, and a lever being pivoted to said support by means of a first pivot and being adapted to allow the user to impart a chosen rotation to said first screw, said lever being able to rotate against a lateral surface of said sole and being rigidly associable therewith, in a chosen position, by way of the insertion of second pivots, which protrude approximately at right angles from the lateral surface of said sole, in a third hole formed in said lever.

7. The shoe of claim 1, wherein said adjustment and guiding mechanism comprises a first seat, which is formed in said sole at the heel region, starting from said bottom, said first seat having an approximately rectangular plan shape which is extended lengthwise in a direction of the longitudinal axis of said sole, an upwardly protruding tab protruding approximately at right angles from the bottom of said first seat and being adjacent to said heel region, said upwardly protruding tab being substantially shaped like a parallelepiped, an upper seat being provided at an upper end of said upwardly protruding tab and having a profile which is approximately U-shaped, a rear hole being provided at the rear surface of the heel, approximately along the longitudinal central axis of said sole and along the same axis of said upper seat, and being approximately T-shaped in a diametrical cross-section, said adjustment and guiding mechanism further comprising a downwardly protruding tab, which protrudes approximately at right angles from the lower surface of said insole proximate to the rear end of said insole, said downwardly protruding tab being arrangeable slidingly at said first seat.

8. The shoe of claim 7, wherein said downwardly protruding tab, shaped approximately like a parallelepiped, is hollow and can be accessed through an opening which has a rectangular plan shape and is formed in the upper surface of said insole, two transverse holes being formed, along the same axis as said rear hole, respectively on the transverse walls of said downwardly protruding tab which are arranged, during use, approximately at right angles to the longitudinal central axis of said sole, a complementarily shaped threaded nut being accommodatable within said downwardly protruding tab and being arranged along the same axis as said transverse holes.

9. The shoe of claim 8, wherein said adjustment and guiding mechanism comprises a second screw, which has a head arranged within said rear hole, from which a stem protrudes which is constituted by a first smooth portion, which is adjacent to said head, followed by a second portion which is threaded complementarily with respect to a thread of said nut, a recess being provided between said first and second portions and being arranged rotatably within said upper seat.

10. The shoe of claim 3, wherein said tip has dimensions that are such that in a condition of maximum retraction of said insole with respect to said shell, and therefore at a minimum size, said tip is arranged outside said slot and is compressed radially by said inner lateral surface of said shell, thus reducing a space inside said sports shoe which is available to accommodate the foot of the user and said innerboot.

11. The shoe of claim 10, wherein in said condition of maximum retraction said tip is not deformed at right angles to said bottom of said shell.

12. The shoe of claim 10, wherein in the condition of minimum retraction of said insole with respect to said shell, and therefore at the maximum size, said tip is arranged at said slot and is in its non-deformed condition, providing more space to the foot of the user and to said innerboot.

13. A sports shoe comprising a rigid sole from which a shell protrudes, starting from a forefoot region and up to a heel region, a quarter being rotatably associated with said shell, an insole being slidingly associated within said shell, at a bottom thereof, said insole being provided with a tip and interacting with an adjustment and guiding mechanism for adjusting and guiding an axial position of said insole with respect to said shell, said adjustment and guiding mechanism comprising a first seat, which is formed in said sole at the heel region, starting from said bottom, said first seat having an approximately rectangular plan shape which is extended lengthwise in a direction of the longitudinal axis of said sole, an upwardly protruding tab protruding approximately at right angles from the bottom of said first seat and being adjacent to said heel region, said upwardly protruding tab being substantially shaped like a parallelepiped, an upper seat being provided at an upper end of said upwardly protruding tab and having a profile which is approximately U-shaped, a rear hole being provided at the rear surface of the heel, approximately along the longitudinal central axis of said sole and along the same axis of said upper seat, and being approximately T-shaped in a diametrical cross-section, said adjustment and guiding mechanism further comprising a downwardly protruding tab, which protrudes approximately at right angles from the lower surface of said insole proximate to the rear end of said insole, said downwardly protruding tab being arrangeable slidingly at said first seat.

14. The shoe of claim 13, wherein said downwardly protruding tab, shaped approximately like a parallelepiped, is hollow and can be accessed through an opening which has a rectangular plan shape and is formed in the upper surface of said insole, two transverse holes being formed, along the same axis as said rear hole, respectively on the transverse walls of said downwardly protruding tab which are arranged, during use, approximately at right angles to the longitudinal central axis of said sole, a complementarily shaped threaded nut being accommodatable within said downwardly protruding tab and being arranged along the same axis as said transverse holes.

15. The shoe of claim 14, wherein said adjustment and guiding mechanism comprises a second screw, which has a head arranged within said rear hole, from which a stem protrudes which is constituted by a first smooth portion, which is adjacent to said head, followed by a second portion which is threaded complementarily with respect to a thread of said nut, a recess being provided between said first and second portions and being arranged rotatably within said upper seat.

* * * * *